US008807716B2

(12) United States Patent
Smith et al.

(10) Patent No.: US 8,807,716 B2
(45) Date of Patent: Aug. 19, 2014

(54) INK DELIVERY

(75) Inventors: Bailey Smith, Bow, NH (US); Joshua Allen, Lebanon, NH (US); Roger Therrien, Hanover, MA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 1028 days.

(21) Appl. No.: 12/164,366

(22) Filed: Jun. 30, 2008

(65) Prior Publication Data

US 2009/0322830 A1 Dec. 31, 2009

(51) Int. Cl.
*B41J 2/17* (2006.01)
*B41J 2/175* (2006.01)

(52) U.S. Cl.
CPC ..... *B41J 2/175* (2013.01)
USPC ..... 347/84; 347/85

(58) Field of Classification Search
None
See application file for complete search history.

(56) References Cited

U.S. PATENT DOCUMENTS

| | | | | |
|---|---|---|---|---|
| 6,250,738 | B1 | 6/2001 | Waller et al. | |
| 6,315,403 | B1 | 11/2001 | Shinozaki | |
| 7,052,117 | B2 * | 5/2006 | Bibl et al. | 347/68 |
| 7,578,588 | B2 * | 8/2009 | Greiser | 347/108 |
| 2005/0117001 | A1 | 6/2005 | Martin | |
| 2005/0270329 | A1 * | 12/2005 | Hoisington et al. | 347/42 |
| 2006/0132537 | A1 * | 6/2006 | Moynihan | 347/40 |
| 2006/0132554 | A1 | 6/2006 | Ota et al. | |
| 2006/0197812 | A1 | 9/2006 | Murakami et al. | |

FOREIGN PATENT DOCUMENTS

| | | | |
|---|---|---|---|
| CN | 1669800 | A | 9/2005 |
| CN | 1980795 | A | 6/2007 |
| CN | 101111384 | A | 1/2008 |
| EP | 0580433 | | 1/1994 |
| JP | 2005-313384 | | 11/2005 |
| JP | 2006-272953 | | 10/2006 |
| JP | 2007-008093 | | 1/2007 |
| WO | WO 2005/070679 | | 8/2005 |
| WO | WO 2006030235 | A2 * | 3/2006 |

OTHER PUBLICATIONS

International Search Report and Written Opinion dated Oct. 30, 2009 in corresponding international application PCT/US2009/046846.
Japanese Office Action in Japanese Application No. JP 2011-516418, mailed Jun. 3, 2013, 5 pages.
Corresponding Chinese application No. 200980131471.3 dated Nov. 30, 2012, 26 pages.
International Preliminary Report on Patentability mailed Jan. 13, 2011 from International Application No. PCT/US2009/046846, 5 pgs.
Chinese Office Action, with English translation, CN application No. 200980131471.3, mailed Jan. 10, 2014, 36 pages.
Japanese Office Action, with English Translation, JP Application No. 2011-516418, mailed Feb. 5, 2014, 9 pages.

* cited by examiner

*Primary Examiner* — Stephen Meier
*Assistant Examiner* — Renee I Wilson
(74) *Attorney, Agent, or Firm* — Fish & Richardson P.C.

(57) ABSTRACT

Among other things, an apparatus for use in ink jetting includes a reservoir system including a reservoir to contain a volume of ink to be delivered to and jetted from at least two jetting assemblies onto a substrate in an ink jetting direction. The reservoir system is located adjacent to at least two of the jetting assemblies along the ink jetting direction.

40 Claims, 6 Drawing Sheets

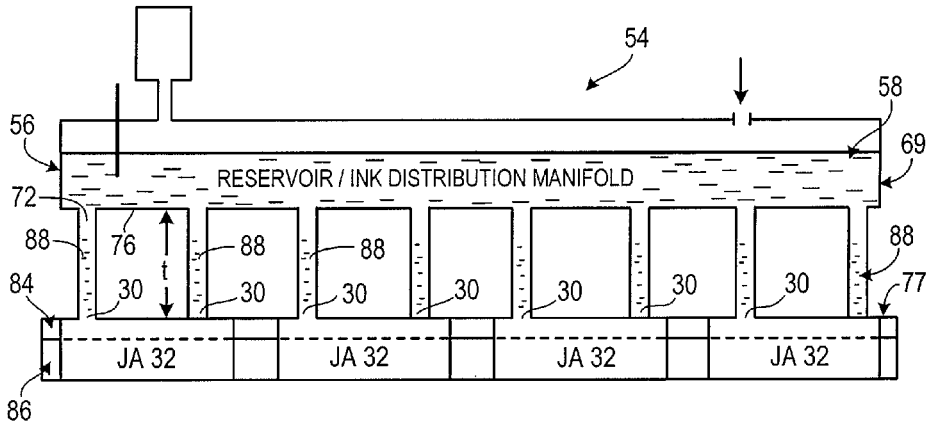
FIG. 2A
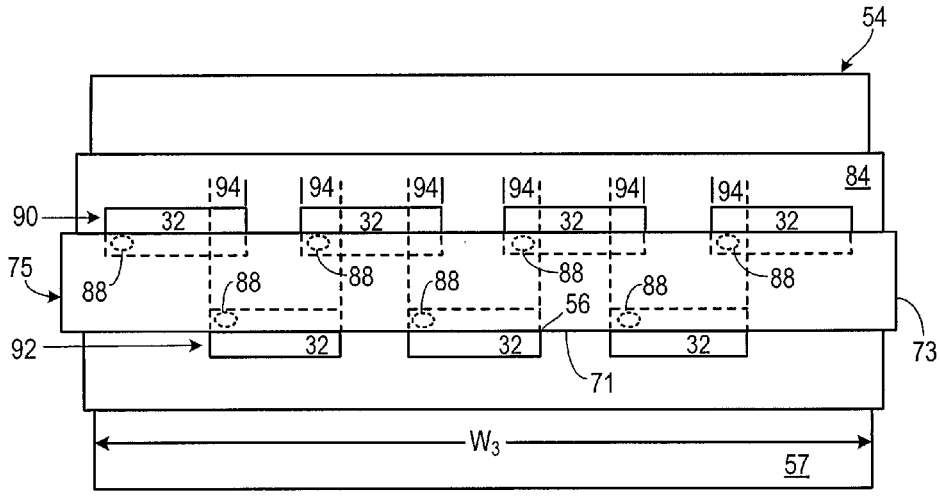
FIG. 3
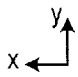

INK DELIVERY

TECHNICAL FIELD

This description relates to ink delivery.

BACKGROUND

Ink can be delivered from an ink reservoir located in an ink jet printer to ink jetting assemblies and when activated, the jetting assemblies jet ink to form images on a substrate.

SUMMARY

Generally, in one aspect, for use in ink jetting, an apparatus includes a reservoir system including a reservoir to contain a volume of ink to be delivered to and jetted from at least two jetting assemblies onto a substrate in an ink jetting direction. The reservoir system is located adjacent to at least two of the jetting assemblies along the ink jetting direction.

Implementations may include one or more of the following features.

The ink reservoir is configured to maintain a free surface on the volume of ink at locations vertically above the jetting assemblies. Ink is delivered to the jetting assemblies from the volume of ink along the ink jetting direction. Ink is delivered horizontally from the volume of ink into the jetting assemblies. The reservoir comprises an inlet to receive ink to replenish the volume of ink. The volume of ink contains a free surface and the reservoir has an interior ceiling taller than the free surface of the volume of ink as ink is jetted and as ink is replenished. The interior ceiling of the reservoir provides a clearance space of at least about 1 to 3 cm on average above the free surface of the volume of ink as ink is jetted and as the volume of ink is replenished. The reservoir comprises a connection from the clearance space to a vacuum. The reservoir comprises at least one outlet to permit ink from the volume of ink to move into the jetting assemblies. The reservoir comprises at least one outlet and each jetting assembly comprises a passage to receive ink from the outlet of the reservoir. The volume of ink contains a free surface and the reservoir system comprises a sensor to sense a height of the free surface in the reservoir. The reservoir is in the form of a chamber to hold the volume of ink and the chamber comprises a metal. The chamber has a depth of about 5 cm. The chamber has a length of about 1 meter. The chamber has a length of about 2 meters. The chamber has a length larger than 1 meter. The chamber includes a rectangular cross-section. The chamber comprises a curved floor. The reservoir and the jetting assemblies are mounted on a first mounting frame. The jetting assemblies are also mounted on a second mounting frame, the first and second mounting frames being arranged adjacent to each other. The jetting assemblies are also mounted on a second mounting frame that comprises an insulation frame. The apparatus also includes a conduit between the reservoir and each jetting assembly to permit ink to move along the ink jetting direction from the volume of ink in the reservoir, along the conduit, and into the ink jetting assembly. The conduit comprises a vertical tube. The conduit comprises a horizontal tube. The jetting assemblies are arranged in a row along a length of the reservoir. The jetting assemblies are arranged in two rows, each row being along a length of the reservoir. The jetting assemblies in one of the two rows are staggered along a length of the reservoir relative to the jetting assemblies in the other of the two rows. The reservoir system comprises additional reservoirs, each of the additional reservoirs being configured to contain a volume of ink. At least some of the reservoirs are configured to contain volumes of ink of different colors. The reservoir is kept level. The first mounting frame is kept level.

In another aspect, for use in ink jetting, an apparatus includes a reservoir system comprising a reservoir to contain a volume of ink to be jetted onto a substrate in an ink jetting direction; a vacuum applied to the volume of ink in the reservoir; at least two jetting assemblies to receive ink from the volume of ink in the reservoir; a conduit between the reservoir and each jetting assembly to conduct ink from the volume of ink in the reservoir to each jetting assembly; and a mounting frame on which the jetting assemblies are mounted; wherein the reservoir is located relative to at least two of the jetting assemblies along the ink jetting direction and ink is delivered from the volume of ink to the jetting assemblies to be jetted.

In another aspect, for use in ink jetting, a method includes delivering ink along an ink delivering direction from a volume of ink to at least two jetting assemblies where the ink is to be jetted onto a substrate in an ink jetting direction, the ink delivering direction being parallel to the ink jetting direction.

Implementations may include one or more of the following features.

The method also includes maintaining a free surface on the volume of ink. The maintaining includes sensing the free surface. The maintaining comprises preventing the free surface from contacting an interior ceiling of a reservoir the volume of ink is contained, as the ink is jetted and as the ink is replenished. Preventing the free surface from contacting the ceiling of the reservoir comprises keeping the free surface at least about 1 cm to about 3 cm on average lower than the interior ceiling of the reservoir. The method also includes applying a vacuum to the free surface. The method also includes replenishing ink in the volume of ink. Delivering ink comprises passing ink from the volume of ink through multiple ink outlets arranged along a length the volume of ink expands to the at least two jetting assemblies. The length the volume of ink expands is larger than 1 meter.

These and other aspects and features can be expressed as methods, apparatus, systems, means for performing a function, and in other ways.

Other features and advantages will be apparent from the following detailed description, and from the claims.

DESCRIPTION

FIGS. 1A, 4A, and 4C are schematic diagrams of side views of ink jet printers.

FIGS. 2 and 2A are schematic diagrams of side views of ink jet printers.

FIG. 3 is a schematic diagram of a top view of an ink jet printer.

Figure 1A:
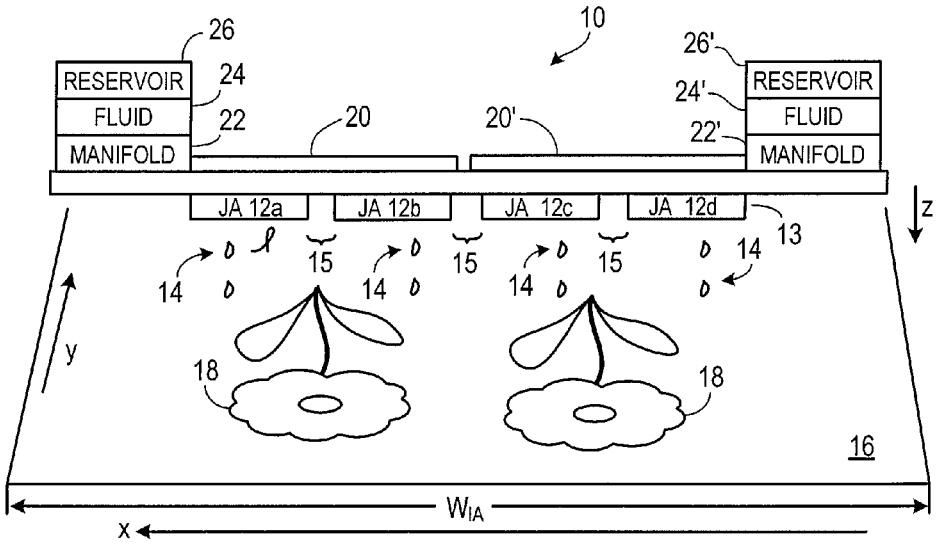
FIG. 1B is an exploded perspective view of a jetting assembly.

Referring to FIG. 1A, when an ink jet printer 10 is in use, ink is delivered from a volume of ink 24 in an ink reservoir 26 to a manifold 22, and delivered along the horizontal direction x to jetting assemblies 12*a* and 12*b* through horizontal feeding tubes 20. Ink drops 14 are jetted from the jetting assemblies 12*a* and 12*b* along an ink jetting direction z to form an image 18 on a substrate 16 that is moving beneath the jetting assemblies 12*a* and 12*b* along a process direction y perpendicular to the x direction across the substrate 16. In some printers, ink is also delivered from a second volume of ink 24' in a second ink reservoir 26' to a second manifold 22' and further to jetting assemblies 12*c* and 12*d* through feed tubes 20'.

Figure 1B:
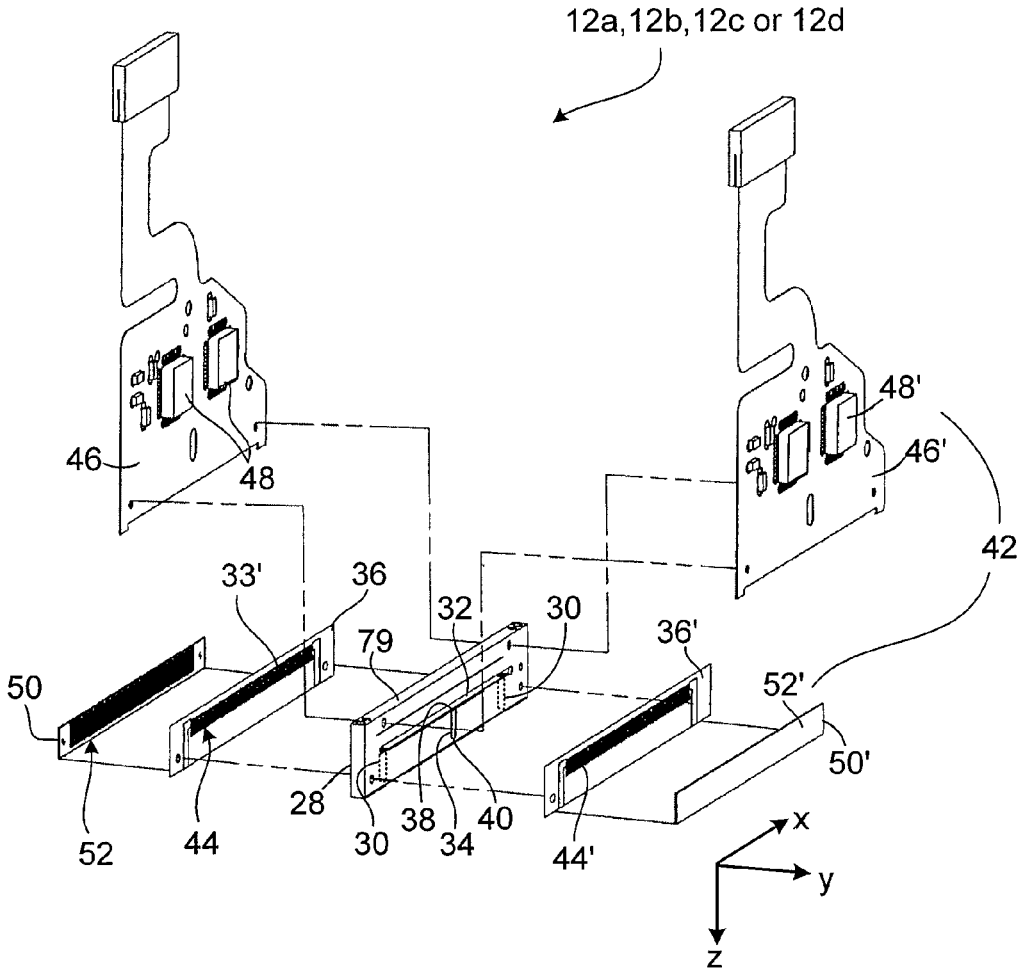

Referring to FIG. 1B, each of the jetting assemblies 12*a*, 12*b*, 12*c*, and 12*d* has a body 28 that includes one or two ink passages 30 and an ink fill passage 32. A cavity plate and a stiffener plate (not shown) are attached on the opposite surfaces of the body 28 to form an array of wells 34 (not all shown) on each surface. The ink passage 30 receives ink from the feeding tubes 20 (FIG. 1A) and delivers ink to the ink fill passage 32. When the opposite surfaces are covered by polymer films 36 and 36', pumping chambers are formed by the wells 34, each including an ink inlet 38 to receive ink from the ink fill passage 32 and an ink outlet end 40 to direct ink back into the body 28 through an ink jetting passage (not shown) and be jetted at an opening (not shown) at the bottom of the body 28.

In some embodiments, an orifice plate (not shown) is attached to the bottom of the body 28. Each orifice on the orifice plate corresponds to one opening and ink is jetted along the ink jetting direction z through the orifices onto the substrate 16 (FIG. 1A). In some embodiments, multiple jetting assemblies like the jetting assemblies 12*a*, 12*b*, 12*c*, and 12*c* can be assembled into one printhead and such a printhead can be used instead of the jetting assemblies in FIG. 1A. Generally, each pumping chamber, together with its corresponding ink jetting passage, the opening at the bottom of the body, and the orifice can be referred to as a jet of the jetting assembly. Information about the jetting assemblies 12*a*, 12*b*, 12*c*, and 12*d* is also provided in U.S. Ser. No. 12/125,648, filed May 22, 2008, which is incorporated here by reference.

Each of the jetting assemblies 12*a*, 12*b*, 12*c*, and 12*d* also includes electronic components 42 to trigger the pumping chambers formed from the wells 34 to jet ink. For example, the electronic components include two sets of electrodes 44 and 44' on the polymer films 36 and 36', which are connected by leads (not shown) to respective flexible printed circuits 46, 46' and integrated circuits 48 and 48'. Piezoelectric elements 50 and 50' are attached to the outer side of each of the polymer films 36 and 36', respectively and each includes a set of electrodes 52 and 52' that contacts the polymer films 36 and 36'. Each electrode 52 or 52' covers a pumping chamber and is capable of activating the corresponding portion of the piezoelectric elements 50 and 50' to subject the covered pumping chamber to a jetting pressure.

In use, pulse voltages sent from the integrated circuits 48 and 48' cause the piezoelectric elements 50 and 50' to change their shapes to apply pressures to selected pumping chambers. More information about the ink jetting assembly is also provided in U.S. Pat. No. 6,755,511, and incorporated here by reference.

Referring back to FIG. 1A, the jetting assemblies 12*a*, 12*b*, 12*c*, and 12*d* are arranged in a row 13 and have their length l (see also FIG. 1B) aligned across the substrate 16 along the x direction so that the combined print swath of the jetting assemblies 12*a*, 12*b*, 12*c*, and 12*d* covers the width $W_{1A}$ of the desired print area of the substrate 16 (number of jetting assemblies shown is schematic). A second row of jetting assemblies (not shown) can be arranged next to the row 13 along they direction. The jetting assemblies in the second row are staggered with respect to the jetting assemblies in the row 13 along the x direction to cover the intervals 15 between the jetting assemblies in the row 13 so that each pixel in a line across the substrate 16 is covered by the jetting assemblies. The details of this arrangement are discussed later. In the example shown in FIG. 1A, ink fed into the ink passages 30 (FIG. 1B) of respective different jetting assemblies 12 by the feeding tubes 20 has passed different distances along the x direction from the ink reservoir 26 and can have different temperatures and/or feeding pressures, which can produce different drop formations and print quality issues in different jetting assemblies 12*a*, 12*b*, 12*c*, and 12*d*. In addition, the feeding tubes 20 can contain air pockets which affect ink flow and when fed to the jetting assemblies 12*a*, 12*b*, 12*c*, and 12*d* may cause the pumping chambers to fail to jet ink when they are triggered. To reduce the variation in temperature and feeding pressure to each jetting assembly along the x direction and facilitate disposal of air pockets, the jetting assemblies 12*a*, 12*b*, 12*c*, and 12*d* and the feeding tubes 20 are often kept leveled.

Figure 2:
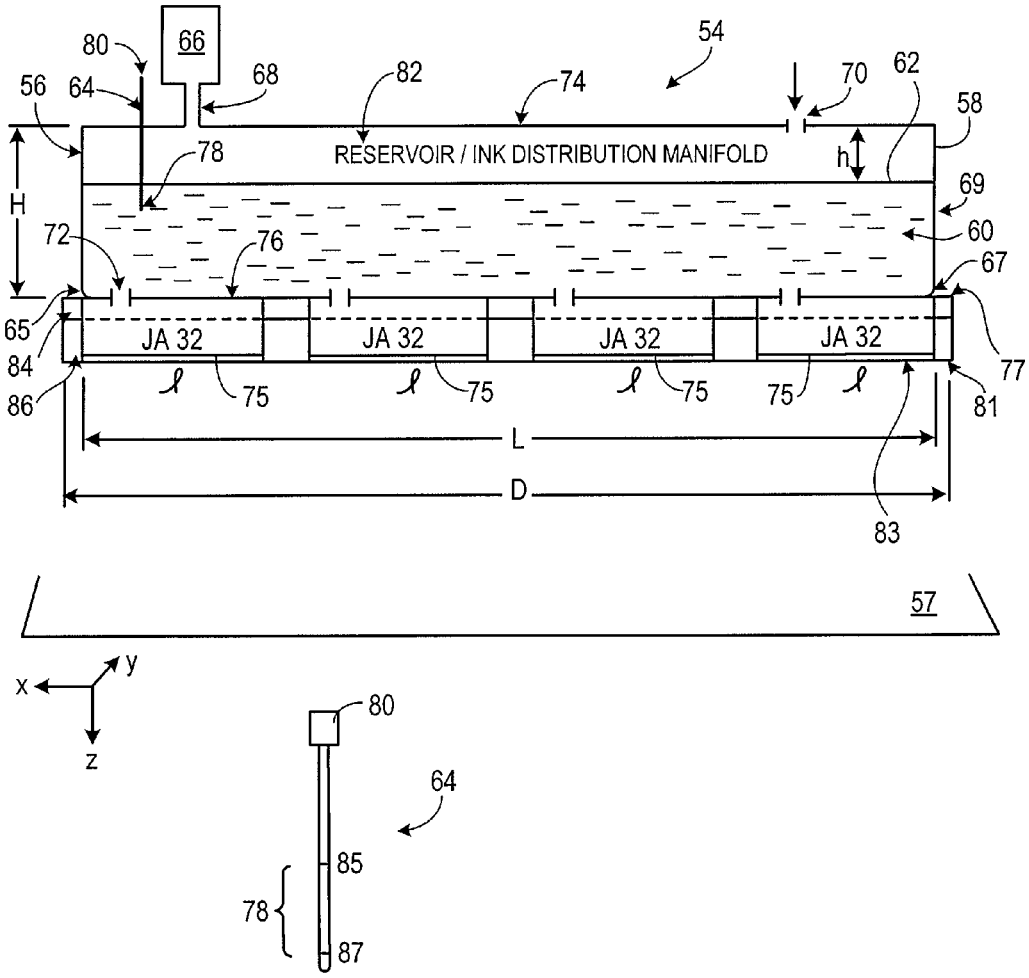
FIG. 2 is a schematic diagram of a side view of an ink jet printer.

Referring to FIG. 2, an ink jet printer 54 includes a reservoir system 56 having a reservoir 58 above one or more jetting assemblies 32 arranged in a row (number of jetting assemblies shown is schematic), each having its length l aligned along the x direction across a substrate 57 and each including similar features as the jetting assembly 12*a*, 12*b*, 12*c*, or 12*b* of FIG. 1B and capable of jetting ink along the ink jetting direction z. In use, ink is replenished from an external ink supply (not shown) through an ink inlet 70 on a ceiling 74 of the reservoir 58 and delivered from a volume of ink 60 in the reservoir 58 down along the jetting direction z through ink outlets 72 on a floor 76 of the reservoir 58 into jetting assemblies 32. The reservoir system 56 also includes a sensor 64 that senses the level of a free surface 62 of the volume of ink 60 that is, for example, vertically above the jetting assemblies 32.

The free surface 62 of the volume of ink 60 is kept lower than the interior of the ceiling 70 to maintain a clearance space 82 including air between the ceiling 70 and the ink free surface 62. In some embodiments, the clearance space 82 has a height h, for example, of at least about 1 cm to at least about 3 cm. The clearance space 82 is open to a vacuum 66 through a connection 68 and the vacuum offsets the effect of the gravity on the ink volume 60 to maintain a proper ink pressure at each ink outlet 72 so that ink is held in the reservoir 58 and does not flood, because of gravity, into the jetting assemblies 32. In some embodiments, the pressure at the free surface 62 of the volume of ink 60 is about the pressure produced by about 1 inch to 7 inches of water. The clearance space 82 also prevents ink from being sucked into the vacuum 66 and disabling the vacuum control to the reservoir system 56.

The reservoir 58 includes a chamber 69 that encompasses the space of the volume of ink 60 and the clearance space 82 and is made of a metal, for example, aluminum, anodized aluminum, or stainless steel. The chamber 69 includes the ceiling 70, the floor 76, and four walls 71, 73, 75, and 79 (FIG. 3) between the ceiling 70 and the floor 76. In the example shown in FIG. 2, the chamber 69 has a rectangular cross-section with its long dimension having a length L, for example, of at least about 20 cm, 50 cm, 100 cm, or 150 cm, and/or up to, e.g., 1 meters, 1.5 meters, 1.8 meters, 2.0 meters, 2.3 meters, 2.5 meters, or more than 3.0 meters. The chamber 69 also includes a depth H along a vertical dimension, for example, of about 3 cm to about 5 cm. The chamber 69 also has a width W (FIG. 4), for example, of about 1.2 to about 2.5 cm. In some embodiments, the interior of the floor 76 can be curved near the corners, such as corner 65 and corner 67, to prevent dead corners, around which ink does not circulate effectively, from being formed in the reservoir 58. Absence of such dead corners can help ink in the chamber 69 to flow easily to the jetting assemblies 32 and can allow the volume of ink to be less for a given ink free surface level. With such a design, ink can be used more efficiently and printing can be done more economically.

In some embodiments, the long dimension L of the reservoir 58 expands a total length of the row of jetting assemblies 32. The row includes, for example, at least 2, 5, 10, 20, 30, 40, 50, 60, 70, or 80 jetting assemblies 32, and/or up to, for example, 100, 120 or even more jetting assemblies 32 along the length L.

The sensor 64 can be a thermal or capacitive sensor. In some embodiments, the sensor 64 includes a sensing portion 78 starting at a first point 85 and ending at a second point 87 on the body of the sensor 64. The sensor portion 78 is placed within the chamber 69 to sense the level of the ink free surface 62. In particular, the first point 85 of the sensor 64 is placed, for example, at least 1.5 cm below the interior of the ceiling 70 and/or the second point 87 of the sensor 64 is for example, about 2 to about 3 cm from the interior of the floor 76. In use, when the ink free surface 62 is above the first point 85, the ink level is high and no more ink should be filled into the reservoir 58 and when ink free surface 62 is below the second point 87, the ink level is low and ink needs to be replenished into the volume of ink 60.

In some embodiments, the ink inlet 70 has a diameter, for example, of about 0.25 cm, 0.5 cm, or about 1 cm, and each of the outlets 72 corresponds to an ink passage 30 (FIG. 1B) of the jetting assembly to fill ink into the corresponding jetting assembly 32 and has a diameter, for example, of about 0.25 cm, and/or up to about 0.35 cm. In some embodiments, each jetting assembly 32 includes two or more passages 30 as described in FIG. 1B and the reservoir 58 includes multiple ink outlets 72 each corresponding to one passage 30 to deliver ink. In some embodiments, each ink outlet 72 is vertically aligned with a corresponding passage 30 of an ink jetting assembly 32.

By maintaining the free surface 62 of the volume of ink 60 vertically above the jetting assemblies 32, ink fills into the jetting assemblies 32 at a substantially even temperature. In some embodiments, to keep the temperature of ink in the volume of ink 60 from being changed by the environment around the reservoir 58, strip or cartridge heaters (not shown) can be mounted on the inside or outside of the chamber 69. For example, the strip heater can be a silicone rubber jacketed strip heater. In such an arrangement, the jetting assemblies 32 and the reservoir 58 are not required to be perfectly leveled because ink flows in the vertical direction.

When the volume of ink 60 contains sufficient amount of ink to cover the floor 76 of the chamber 69, the ink delivery from the ink outlets 72 to one of the jetting assemblies 32 is independent of the ink delivery to other jetting assemblies 32. This allows easier and lower-cost manufacturing of the ink jet printer 28. The arrangement of the reservoir system 56 also allows air pockets in the volume of ink 34 to be removed into the clearance space 52 easily and prevents them from reaching the outlets 72. In addition, by placing the reservoir system 56 above the jetting assemblies 32, the overall length D of the ink jet printer 54 is smaller so that the printer is spatially more economical. For example, the overall length D is similar to the length L of the reservoir 58 and ranges between 20 cm and 3 m or even longer.

The jetting assemblies 32 are mounted in mounting frames 84 and 86 that are positioned adjacent to each other, for example, one above the other. In some embodiments, the upper surface 77 of the mounting frame 84 is aligned with the upper surface 79 of the body 28 (FIGS. 1A and 1B) of each jetting assembly 32, and the lower surface 81 of the mounting frame 86 is aligned with the lower surfaces 83 of the orifice plates 75 mounted at the bottom of the body 28 (FIGS. 1A and 1B) of the jetting assembly 32. The reservoir system 56 is mounted on top of the mounting frame 84, for example, contacting the upper surface 77 of the mounting frame 84 having the ink outlets 72 vertically aligned with the ink passages 30 (FIG. 1B) of the jetting assemblies 32. In some embodiments, the lower surface 81 of the mounting frame 86 makes the orifice plates 75 recessed by about 0.003 inch to about 0.010 inch.

The mounting frame 84 is made of a metal, for example, aluminum, or stainless steel and has a thickness of about 1 cm to about 2 cm. The mounting frame 86 includes an insulating material, for example, polyoxymethylene, which is also known as Delrin (Dupont, Wilmington, Del.), and have a thickness of about 1 cm to about 2 cm. The insulating mounting frame 86 keeps the jetting assemblies 32 at a desired, for example, uniform, temperature, which allows for consistent jetting performance.

Referring to FIG. 2A, the reservoir system 56 is elevated above the upper surface 77 of the mounting frame 84 and connected to the jetting assemblies 32 through a row of conduits 88 (number of jetting assemblies shown is schematic). In some embodiments, each conduit 88 is a vertical tube connecting each ink outlet 72 to a passage 30 (FIG. 1B) of a corresponding jetting assembly 32. In the example shown in FIG. 2A, some of the conduits 88 are connecting the ink outlets 72 to jetting assemblies in a different row (FIG. 3) than the exemplified jetting assembly row. Ink is delivered from the reservoir 58 in the reservoir system 56, out of the outlets 72, through the conduits 88, and down into the jetting assemblies 32 along the ink jetting direction z.

The conduits 88 can be made of substantially the same material as the reservoir chamber 69. In some embodiments, each of the conduits 88 has a length t, for example, of about 2 to about 10 cm. This arrangement can provide flexibility in design and be used, for example, in situations where clearance space is needed between the upper surface 77 of the mounting frame 84 and the floor 76 of the chamber 69.

Referring to FIG. 3, the ink reservoir system 56 can deliver ink to two rows 90 and 92 of jetting assemblies 32 in a staggered arrangement (number of jetting assemblies shown is schematic). Each jetting assembly 32 of one of the rows 90 and 92 at least partially overlaps with a corresponding jetting assembly 32 of the other row in overlapping regions 94. Such staggering arrangement of the jetting assembly rows 90 and 92 increases the span of the jetting assemblies 32 to cover the width $W_3$ of the substrate 57 and improve the precision and quality of the printing by using the multiple jetting assemblies 32 across the substrate 57.

The printer 54 can include more than one reservoir system arranged along the process y direction that is perpendicular to the width of the substrate 57, each having the same features as the reservoir system 56 of FIGS. 2, and 2A, mounted on the mounting frames 84 and 86 and capable of feeding ink to two rows of jetting assemblies arranged as the arrays 90 and 92 of FIG. 3. In some embodiments, the printer 54 includes four reservoir systems, each having a reservoir containing ink with a color, for example, cyan, magenta, yellow, or black, different from the others to print colored images.

Figure 4A:
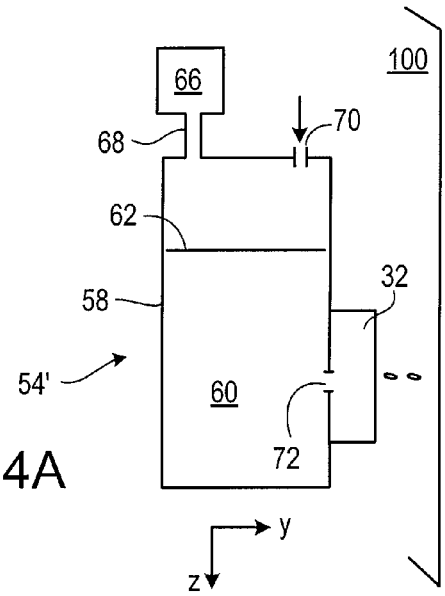
FIGS. 4B and 4D are exploded perspective view of ink jet printers.
Figure 4B:
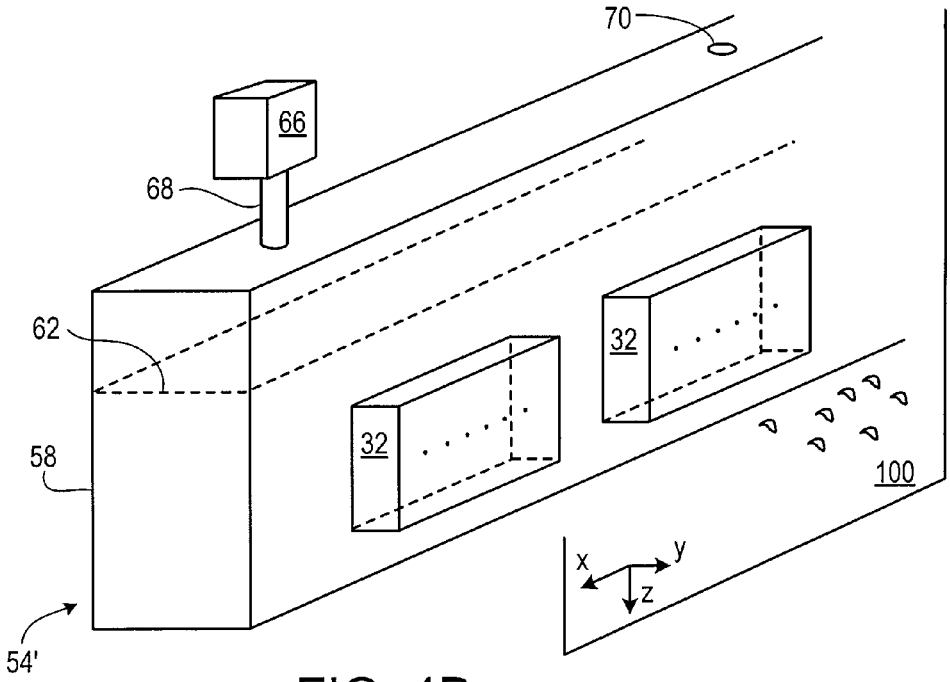

Referring to FIGS. 4A and 4B, with minor modifications to the ink jet printer 54 of FIGS. 2 and 3, for example, rearranging the locations of the vacuum 66, sensor 64, and ink inlet 70 with respect to each ink reservoir 58 appropriately so that the reservoir systems 56 can operate properly in the manner described above, the ink jet printer 54 can rotate about the x direction, for example, by 90 degrees to form a printer 54' (mounting plates and nozzle plates are not shown) that jets ink in a horizontal ink jetting direction y onto a substrate 100 that is moving along the vertical direction z. The free surface 62 of the volume of ink 60 is maintained above the ink outlets 72, from which ink is delivered into the jetting assemblies 32 along the ink jetting direction y.

Figure 4C:
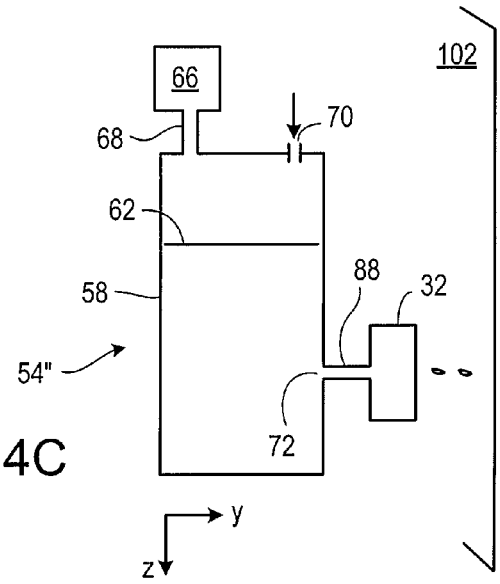
Figure 4D:
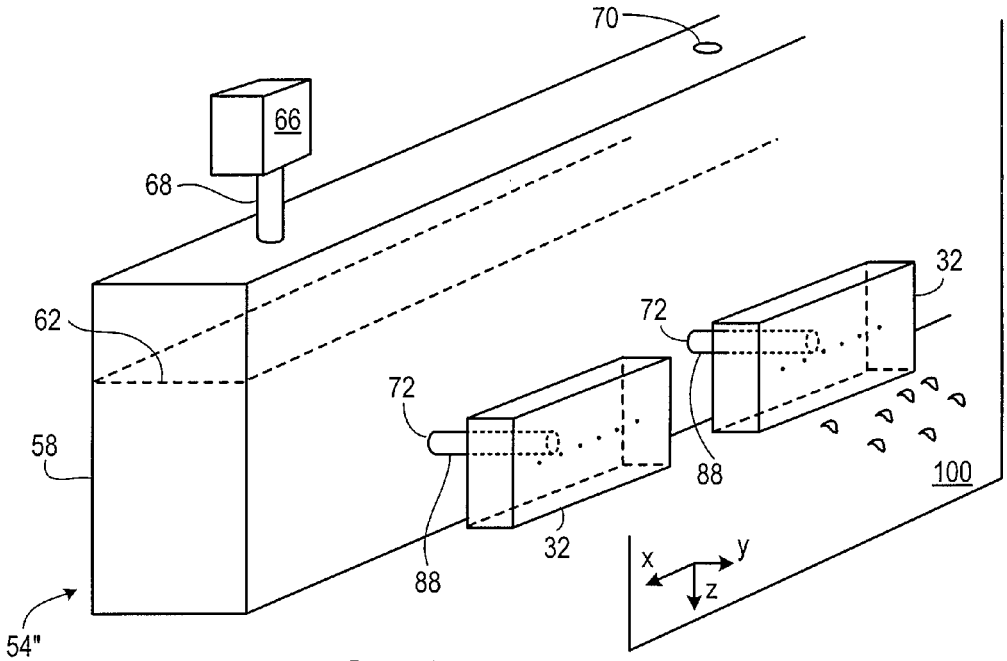

Referring to FIGS. 4C and 4D, similar rotation and modifications can also be done to the ink jet printer 54 of FIGS. 2A and 3 to form a printer 54" that is capable of jetting ink in a horizontal ink jetting direction y on to a substrate 102 that is moving vertically along the direction z. Similarly, the free surface 62 of the volume of ink 60 is maintained above the ink outlets 72, from which ink is delivered through horizontal conduits 88 into the jetting assemblies 32 along the ink jetting direction y.

Other embodiments are also within the scope of the following claims.

For example, the shape of the reservoir chamber 69 can be different from rectangular. The dimensions of the ink chamber 69 can be different from those described above. For example, the length L, depth H, and width W of the ink chamber 69 can be larger or smaller than the values listed above. The ink inlet 70 can also be located on one of the walls 71, 73, 75, and 79 between the ceiling and the floor of the reservoir chamber 69. The ink inlet 70 can be either above or below the free surface 62 of the volume of ink 60.

Jetting assemblies other than that shown in FIG. 1B can be used, for example, jetting assemblies that are made of silicon and described in U.S. Pat. No. 5,265,315, and jetting assemblies or printheads that are described in U.S. Ser. No. 12/125,648, filed May 22, 2008, both of which are incorporated here by reference. The number of jetting assemblies 32 assembled along across the substrate 57 can vary, depending on the length of each jetting assembly and the width of the substrate.

Only one or more than two mounting frames can be used. Each jetting assembly 32 can include more than one ink passage 30 and more than one conduit 88 can be used to connect the ink passages 30 of each jetting assembly 32 with the ink outlets 72. The conduits 88 can be non-vertical, depending on the relative position of each ink outlet 72 and its corresponding ink passage 30. The upper surface 79 of the jetting assembly body 28 can be in a different plane than the upper surface 77 of the mounting frame 84. The lower surface 83 of the jetting assembly body 28 can be in a different plane than the lower surface 81 of the mounting plate 86. Each of the mounting plates 84 and 86 can have a thickness different from those described above.

What is claimed is:

1. An apparatus for use in ink jetting comprising:

at least two jetting assemblies mounted in openings of a mounting frame, the mounting frame comprising an insulating frame including a thermally insulating material, each jetting assembly comprising one inlet; and a reservoir to contain a volume of ink to be delivered to and jetted from the at least two jetting assemblies onto a substrate in an ink jetting direction, the reservoir being located adjacent to the at least two jetting assemblies and aligned with at least a portion of each of the at least two jetting assemblies along the ink jetting direction, the reservoir comprising at least two outlets, each outlet being aligned with a corresponding inlet of a jetting assembly to fill ink directly from each outlet into the corresponding inlet without any additional conduit between the outlet and its corresponding inlet.

2. The apparatus of claim 1 in which the reservoir is configured to maintain a free surface on the volume of ink at locations vertically above the jetting assemblies.

3. The apparatus of claim 1 in which ink is delivered to the jetting assemblies from the volume of ink along the ink jetting direction.

4. The apparatus of claim 1 in which ink is delivered horizontally from the volume of ink into the jetting assemblies.

5. The apparatus of claim 1 in which the volume of ink contains a free surface and the reservoir has an interior ceiling taller than the free surface of the volume of ink as ink is jetted and as ink is replenished.

6. The apparatus of claim 5 in which the interior ceiling of the reservoir provides a clearance space of at least about 1 to 3 cm on average above the free surface of the volume of ink as ink is jetted and as the volume of ink is replenished.

7. The apparatus of claim 6 in which the reservoir comprises a connection from the clearance space to a vacuum.

8. The apparatus of claim 1 in which the volume of ink contains a free surface and the apparatus further comprises a sensor to sense a height of the free surface in the reservoir.

9. The apparatus of claim 1 in which the reservoir is in the form of a chamber to hold the volume of ink and the chamber comprises a metal.

10. The apparatus of claim 9 in which the chamber has a depth of about 5 cm.

11. The apparatus of claim 9 in which the chamber has a length of about 1 meter.

12. The apparatus of claim 9 in which the chamber has a length of about 2 meters.

13. The apparatus of claim 9 in which the chamber has a length larger than 1 meter.

14. The apparatus of claim 9 in which the chamber includes a rectangular cross-section.

15. The apparatus of claim 9 in which the chamber comprises a curved floor.

16. The apparatus of claim 1 in which the reservoir and the jetting assemblies are mounted on another mounting frame.

17. The apparatus of claim 16 in which the mounting frames are arranged adjacent to each other.

18. The apparatus of claim 1 in which the jetting assemblies are arranged in a row along a length of the reservoir.

19. The apparatus of claim 1 in which the jetting assemblies are arranged in two rows, each row being along a length of the reservoir.

20. The apparatus of claim 19, in which the jetting assemblies in one of the two rows are staggered along a length of the reservoir relative to the jetting assemblies in the other of the two rows.

21. The apparatus of claim 1 further comprising additional reservoirs, each of the additional reservoirs being configured to contain a volume of ink.

22. The apparatus of claim 21 in which at least some of the reservoirs are configured to contain volumes of ink of different colors.

23. The apparatus of claim 1 in which the reservoir is kept level.

24. The apparatus of claim 16 in which the other first mounting frame is kept level.

25. An apparatus for use in ink jetting comprising:

a reservoir to contain a volume of ink to be jetted onto a substrate in an ink jetting direction, the reservoir comprising a reservoir material;

a vacuum applied to the volume of ink in the reservoir;

at least two jetting assemblies to receive ink from the volume of ink in the reservoir;

a conduit between the reservoir and each jetting assembly to conduct ink from the volume of ink in the reservoir to each jetting assembly, the conduit comprising the reservoir material; and a mounting frame on which the jetting assemblies are mounted, the mounting frame comprising an insulating frame including a thermally insulating material;

wherein the reservoir is aligned with at least a portion of each of the at least two jetting assemblies along the ink jetting direction, and ink is delivered from the volume of ink to the jetting assemblies to be jetted.

26. The apparatus of claim 25 in which the reservoir comprises a chamber having a length longer than 1 meter.

27. A method for use in ink jetting, the method comprising:

delivering ink along an ink delivering direction from a volume of ink to at least two jetting assemblies where the ink is to be jetted onto a substrate in an ink jetting direction, the ink delivering direction being parallel to the ink jetting direction; wherein the at least two jetting assemblies being mounted in openings of a mounting frame, the mounting frame comprising an insulating frame including a thermally insulating material, each jetting assembly comprising one inlet; and the volume of ink is contained in a reservoir comprising at least two outlets, each outlet being aligned with a corresponding inlet of a jetting assembly to fill ink directly from each outlet into the corresponding inlet without any additional conduit between the outlet and its corresponding inlet.

28. The method of claim 27 also includes maintaining a free surface on the volume of ink.

29. The method of claim 28 in which the maintaining includes sensing the free surface.

30. The method of claim 29 in which the maintaining comprises preventing the free surface from contacting an interior ceiling of a reservoir in which the volume of ink is contained, as the ink is jetted and as the ink is replenished.

31. The method of claim 30 in which preventing the free surface from contacting the ceiling of the reservoir comprises keeping the free surface at least about 1 cm to about 3 cm on average lower than the interior ceiling of the reservoir.

32. The method of claim 28 further comprising applying a vacuum to the free surface.

33. The method of claim 27 further comprising replenishing ink in the volume of ink.

34. The method of claim 27 in which delivering ink comprises passing ink from the volume of ink through multiple ink outlets arranged along a length the volume of ink expands to the at least two jetting assemblies.

35. The method of claim 34 in which the length the volume of ink expands is larger than 1 meter.

36. The apparatus of claim 16 in which the other mounting frame comprises a metal.

37. The apparatus of claim 1 in which each outlet of the reservoir has a diameter that matches a diameter of the corresponding inlet of the jetting assembly.

38. The apparatus of claim 25 in which the reservoir material comprises a metal including aluminum, anodized aluminum, or stainless steel.

39. The apparatus of claim 25 in which the conduit comprises a vertical tube.

40. The apparatus of claim 25 in which the conduit comprises a horizontal tube.

* * * * *